US010676945B2

(12) United States Patent
Cockerell

(10) Patent No.: US 10,676,945 B2
(45) Date of Patent: Jun. 9, 2020

(54) BUILDING SHEATH DROP NETTING SYSTEM AND RELATED METHODOLOGY

(71) Applicant: Safety Guys, LLC, Dania Beach, FL (US)

(72) Inventor: Chris Cockerell, Hollywood, FL (US)

(73) Assignee: Safety Guys, LLC, Dania Beach, FL (US)

( * ) Notice: Subject to any disclaimer, the term of this patent is extended or adjusted under 35 U.S.C. 154(b) by 0 days.

(21) Appl. No.: 15/611,709

(22) Filed: Jun. 1, 2017

(65) Prior Publication Data

US 2018/0347219 A1 Dec. 6, 2018

(51) Int. Cl.
*E04G 21/32* (2006.01)

(52) U.S. Cl.
CPC ..... *E04G 21/3266* (2013.01)

(58) Field of Classification Search
CPC ..... E04G 21/3266; E04G 21/3261
USPC ..... 182/138, 137, 139, 140; 160/330, 368.1
See application file for complete search history.

(56) References Cited

U.S. PATENT DOCUMENTS 2,687,863 A * 8/1954 Vogt ..... H01Q 1/1221 248/284.1
3,338,007 A * 8/1967 Draplin ..... B60J 10/70 52/204.597
3,342,444 A * 9/1967 Nelson ..... E04H 12/2215 248/156
3,630,474 A * 12/1971 Minor ..... F21V 21/10 52/98
3,762,110 A * 10/1973 Boss, Jr. ..... E04G 21/28 52/63
3,949,834 A * 4/1976 Nusbaum ..... E04G 21/3261 182/138
4,074,791 A * 2/1978 Inman ..... A62B 1/22 182/138
4,129,197 A * 12/1978 Preston ..... E04G 21/3223 182/82
4,193,231 A * 3/1980 Molyneux ..... E06B 1/705 49/505
4,462,123 A * 7/1984 Morris ..... E03F 5/0407 4/286
4,685,263 A * 8/1987 Ting ..... E04B 2/92 52/235
4,732,234 A * 3/1988 Brickman ..... E04G 21/3266 182/138
D297,370 S * 8/1988 Foster, Jr. ..... D25/133
4,825,612 A * 5/1989 Tupman ..... E04F 19/062 52/288.1

(Continued)

*Primary Examiner* — Katherine W Mitchell
*Assistant Examiner* — Shiref M Mekhaeil
(74) *Attorney, Agent, or Firm* — Berger Singerman, LLP; Geoffrey Lottenberg

(57) ABSTRACT

A drop netting system for multi-floor construction for retaining debris has multiple rows of spaced apart brackets. Each bracket includes a base plate assembly attached to a surface of the building and a pole extending perpendicularly away from the base plate. One or more drop nets is attached to the distal ends of the poles and is the nets are suspended across the multiple rows of brackets to form a protective sheath on the building structure. The nets are spaced away from the surface of the building to permit access for construction work while retaining and preventing the spread of debris. The nets may be attached in breakaway fashion to cables attached across the distal ends of the poles of each bracket.

5 Claims, 8 Drawing Sheets

(56) References Cited

U.S. PATENT DOCUMENTS 4,838,382 A 6/1989 Nusbaum
4,856,615 A * 8/1989 Nusbaum ..... E04G 21/3261 182/82
4,892,169 A * 1/1990 Duncan ..... E04G 21/3223 182/138
4,944,365 A 7/1990 Shalders
4,962,828 A 10/1990 Duncan
5,058,964 A * 10/1991 Reuschel ..... A47B 83/045 312/111
5,161,641 A * 11/1992 Nusbaum ..... E04G 21/3223 182/129
5,226,263 A * 7/1993 Merrin ..... E04D 13/1476 285/42
5,299,654 A * 4/1994 Duncan ..... E04G 21/3266 182/138
5,299,655 A * 4/1994 Margaritis ..... E01D 19/106 182/138
5,429,206 A 7/1995 Nusbaum
5,568,708 A * 10/1996 Kassardjian ..... B29C 45/14065 138/96 R
5,582,266 A * 12/1996 Rexroad ..... A62B 1/22 182/138
5,673,769 A * 10/1997 Rexroad ..... A62B 1/22 182/138
5,699,641 A * 12/1997 Tinen ..... E04B 9/006 248/343
5,794,387 A * 8/1998 Crookham ..... F21V 21/36 52/122.1
5,842,685 A * 12/1998 Purvis ..... E04G 21/3223 256/67
5,884,725 A * 3/1999 Reyland ..... E04G 1/15 182/113
6,000,498 A * 12/1999 Rexroad ..... E04G 21/3261 182/138
D421,708 S * 3/2000 Kuhnke ..... D8/349
6,042,203 A * 3/2000 Bogucki ..... A47B 21/00 108/143
6,161,648 A * 12/2000 Rexroad ..... A62B 1/22 182/138
6,302,824 B1 * 10/2001 MacAdam ..... A63B 9/00 482/33
6,481,173 B1 * 11/2002 Roy ..... H04R 1/02 181/150
6,554,257 B1 * 4/2003 Kenton ..... E04G 21/3233 256/24
6,554,624 B1 * 4/2003 Yu ..... H01R 13/193 439/135
6,612,082 B2 * 9/2003 Schimmelpfennig ... E04C 5/161 248/523
6,698,142 B2 * 3/2004 Denny ..... E04H 3/12 182/138
6,779,630 B2 * 8/2004 Choate ..... A62B 35/0056 182/36
6,938,871 B1 * 9/2005 Carlson ..... G09F 17/00 248/519
7,048,090 B2 * 5/2006 Dean ..... A62B 35/0056 182/3
7,241,079 B2 * 7/2007 Francis ..... E02D 5/56 248/530
7,258,198 B2 * 8/2007 Rexroad ..... E04G 21/3266 182/138
7,322,553 B2 1/2008 Rexroad
7,389,855 B2 * 6/2008 Rexroad ..... E04G 21/3266 182/138
7,389,955 B2 6/2008 Rexroad
7,600,274 B2 * 10/2009 Washington ..... A47K 3/38 160/124
7,694,487 B1 * 4/2010 Ryan ..... E04H 12/2269 248/156
7,823,347 B1 * 11/2010 Blinn ..... B66C 23/62 182/186.7
7,841,378 B2 * 11/2010 Henning ..... E01F 7/025 160/327
7,861,485 B1 * 1/2011 Wentworth ..... E04D 1/30 52/745.06
8,123,168 B2 * 2/2012 Switzer ..... B64C 1/1492 244/129.3
8,245,816 B2 * 8/2012 Guinart Pallares ..... E04G 5/04 182/138
8,511,039 B2 * 8/2013 Dougall ..... E04G 21/3219 52/745.05
9,033,106 B2 * 5/2015 Blinn ..... E04G 21/3266 182/139
9,038,777 B2 * 5/2015 Stearns ..... A62B 1/22 182/138
D730,724 S * 6/2015 Brown ..... F24F 13/32 D8/380
9,528,285 B2 * 12/2016 Blinn ..... E04G 21/3266
9,976,698 B1 * 5/2018 Davis ..... F16M 13/02
10,022,572 B2 * 7/2018 Wolter ..... A62B 35/0056
10,024,071 B2 * 7/2018 Cockerell ..... E04G 21/3266
10,030,397 B2 * 7/2018 Stearns ..... A62B 1/22
10,159,881 B2 * 12/2018 Hulbert ..... A63B 63/008
2003/0075385 A1 * 4/2003 Walls ..... E04G 5/14 182/138
2006/0090961 A1 * 5/2006 Rexroad ..... A62B 1/22 182/138
2006/0151243 A1 * 7/2006 Rexroad ..... A62B 1/22 182/138
2006/0214150 A1 * 9/2006 Cockerell ..... E04G 21/3266 256/67
2006/0237607 A1 10/2006 Rexroad
2007/0102241 A1 * 5/2007 Rexroad ..... E04G 21/3266 182/138
2009/0120718 A1 * 5/2009 O'Gorman ..... E04G 21/3223 182/113
2011/0078970 A1 * 4/2011 Boyd ..... E04B 9/241 52/506.07
2011/0315474 A1 * 12/2011 Wiser ..... A62B 35/0056 182/3
2013/0168626 A1 * 7/2013 Blinn ..... E04G 21/3266 256/31
2015/0027074 A1 * 1/2015 Preston ..... E04F 13/06 52/302.1
2017/0020287 A1 * 1/2017 Tremaine ..... A47B 96/1466
2018/0044931 A1 * 2/2018 Cockerell ..... E04G 21/3266
2018/0320444 A1 * 11/2018 Beard ..... E06C 1/12

* cited by examiner

BUILDING SHEATH DROP NETTING SYSTEM AND RELATED METHODOLOGY

FIELD OF THE INVENTION

This application generally relates to safety and debris netting for multi-floor construction and more particularly to a sheath-style drop netting system for multi-floor or other types of construction and related methodology.

BRIEF DESCRIPTION OF THE DRAWINGS

The drawings appended hereto are mere schematics representations, not intended to portray specific parameters of the invention. Understanding that these drawing(s) depict only typical embodiments of the invention and are not, therefore, to be considered to be limiting its scope, the invention will be described and explained with additional specificity and detail through the use of the accompanying drawing(s), in which:

FIG. 7 is a side view of another embodiment of a base assembly having an eyelet.

DETAILED DESCRIPTION

Figure 1:
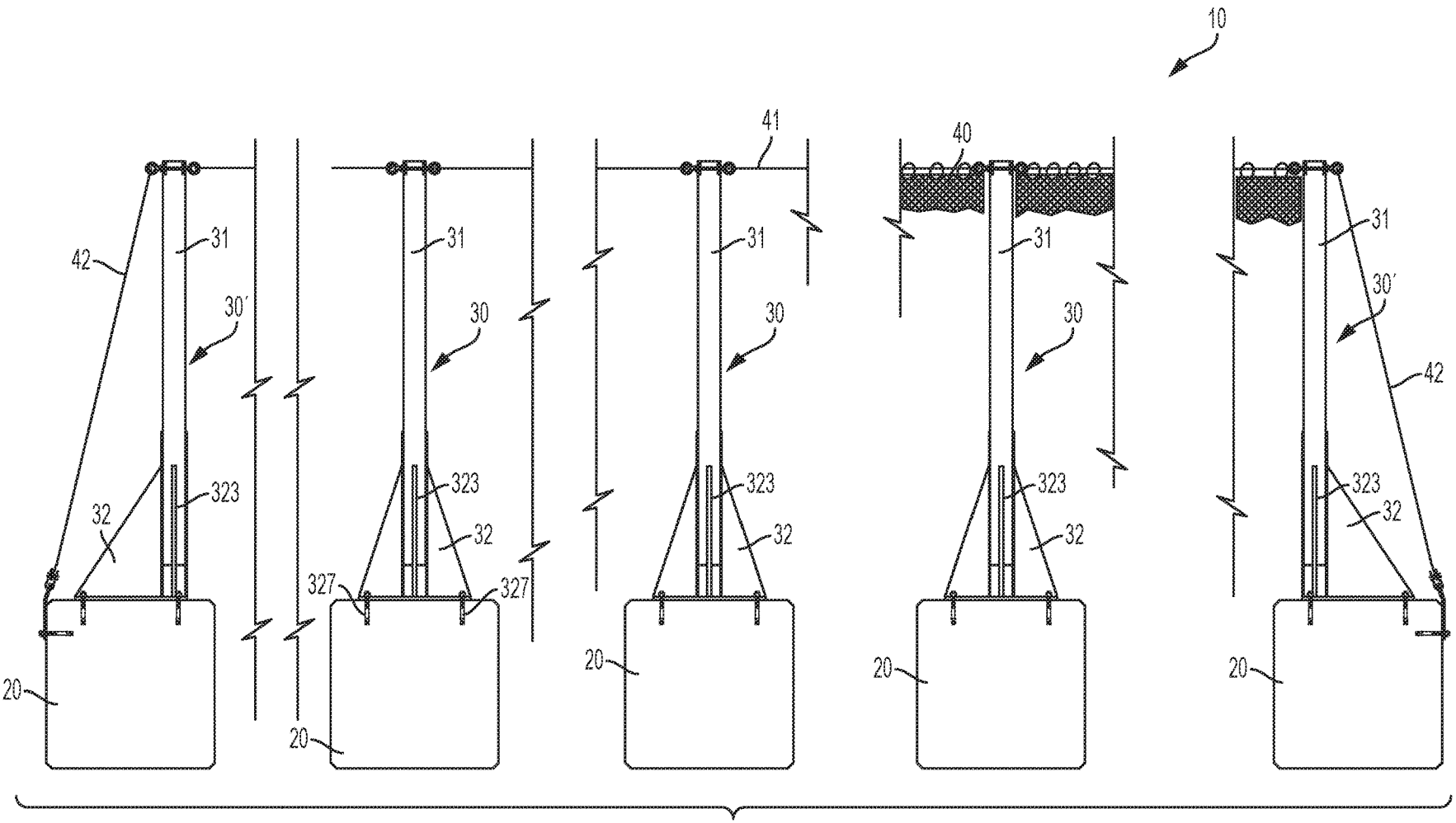
FIG. 1 is a top view schematic of one embodiment of the drop netting system.

For the purposes of promoting an understanding of the principles of this disclosure, reference will now be made to the exemplary embodiments illustrated in the drawing(s), and specific language will be used to describe the same. It will nevertheless be understood that no limitation of the scope of the invention is thereby intended. Any alterations and further modifications of the inventive features illustrated herein, and any additional applications of the principles of the invention as illustrated herein, which would occur to one skilled in the relevant art and having possession of this disclosure, are to be considered within the scope of the invention.

Reference throughout this specification to an "embodiment," an "example" or similar language means that a particular feature, structure, characteristic, or combinations thereof described in connection with the embodiment is included in at least one embodiment of the present invention. Thus, appearances of the phrases an "embodiment," an "example," and similar language throughout this specification may, but do not necessarily, all refer to the same embodiment, to different embodiments, or to one or more of the figures. Additionally, reference to the wording "embodiment," "example" or the like, for two or more features, elements, etc. does not mean that the features are necessarily related, dissimilar, the same, etc. The features, functions, and the like described herein are considered to be able to be combined in whole or in part one with another as the claims and/or art may direct, either directly or indirectly, implicitly or explicitly.

As used herein, "comprising," "including," "containing," "is," "are," "characterized by," and grammatical equivalents thereof are inclusive or open-ended terms that do not exclude additional un-recited elements or method steps. As used herein the term "distal" generally is understood to mean that which is situated away from the center of the identified structure or from the point of attachment of said structure. The term "proximal" generally is understood to mean that which is situated nearer to the center of the body or to the point of attachment.

With reference to FIG. 1 shown is a schematic of one embodiment of the drop netting system 10 installed on an exemplary building. The system 10 comprises array or a plurality of spaced apart brackets 30 attached at predetermined points across the face or surface of a building, such as exemplary columns 20, so as to form an array of attachment points for a drop net to be attached to and suspended from the brackets 30. Brackets 30 configured for use at the outer ends or edges of the target building are referred to herein as end brackets 30' as, in some embodiments, end brackets 30' have a slightly different construction although working together and cohesively with the other brackets 30. Each bracket 30 and 30' comprises a base pole 31 and a base plate assembly 32 with the pole 31 extending outward from the base plate assembly 32. The base plate assembly 32 is affixed to the column 20 or other support surface and, in some embodiments, is mounted flush thereto for a secure fit. The pole 31 of each bracket 30 extends outward from their respective base plate assembly 32 and, in turn, columns 20, substantially perpendicular thereto. A drop net 40 is secured to the distal end of the pole 31 of each bracket 30 and suspended therefrom such that the drop net is spaced away from the building in such a manner to permit construction workers to have access of to the side of the structure in order to carry out construction work, while also benefiting from the safety and debris retaining functionality of the net 40. The spaced-apart configuration of the net 40 is particularly useful for stucco, concrete, paint and masonry workers that need access to the building and will be using construction materials that are prone to creating debris and loss of building material. The resultant system 10 provides protection against the spread of debris down and around the building on which it is installed and protects against property damage to adjacent areas and buildings. The system 10 may also provide certain safety features to catch falling construction workers, depending on the specific type and location of net 40 selected.

In some embodiments, the net 40 (which is shown in partial view to more clearly show the invention as a whole) is retained and attached to cables 41 and 42 wherein cable 41 is attached across and between the distal end of each pole 31 and the cable 42 is attached at one end to the distal end of the respective outer brackets 30' and at the other end to the column 20. The net 40 may be attached to the cable 41 by snap hooks, zip ties, or other resilient or frangible retention fasteners. In some cases it is desirable to use heavy duty reinforced zip ties (120 LB rating, 0.30" width, nylon) in order to allow the net to break away from the poles 31 in high winds in order to limit damage to the system 10 in extreme conditions.

Figure 2E:
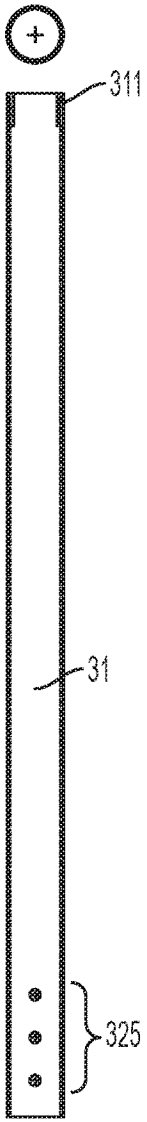
FIG. 2E is a side view of a pole for a bracket of the embodiment shown in FIG. 1.
Figure 2B:
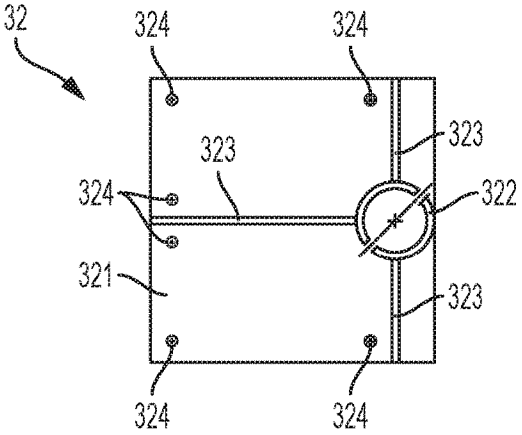
FIG. 2B is a top view of a base plate assembly for an end bracket of the embodiment shown in FIG. 1.
Figure 2D:
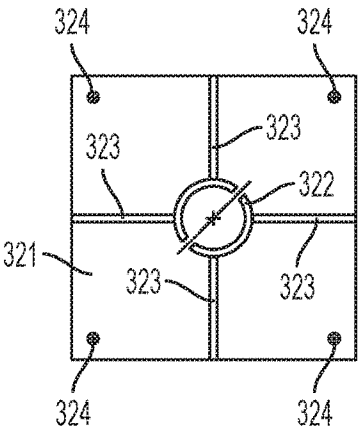
FIG. 2D is a top view of a base plate assembly for a standard bracket of the embodiment shown in FIG. 1.
Figure 2A:
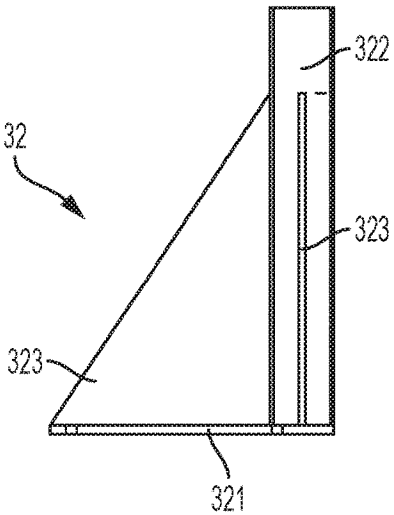
FIG. 2A is a side view of a base plate assembly for an end bracket of the embodiment shown in FIG. 1.
Figure 2C:
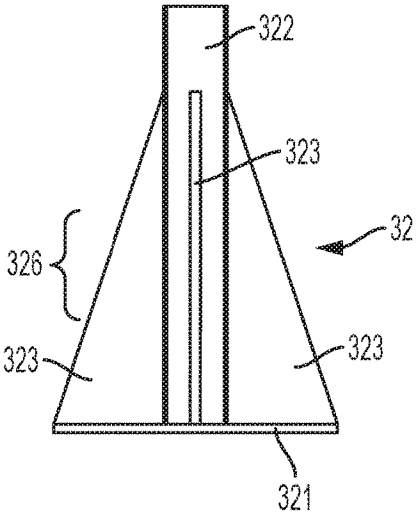
FIG. 2C is a side view of a base plate assembly for a standard bracket of the embodiment shown in FIG. 1.

FIGS. 2A-2E show the various components of the system 10 in isolation. FIGS. 2A-2B are side and front views, respectively, of one embodiment of the base plate assembly 32, configured for use as part of an end bracket 30'. FIGS. 2C-2E are side and front views, respectively, of one embodiment of the base plate assembly 32, configured for use as part of an a "standard" bracket 30. For purposes of this disclosure, the modifying term "standard" with respect to bracket 30 is used to distinguish the configuration of bracket 30 from the configuration of end bracket 30', whereby the standard bracket 30 comprises any other type of bracket described or contemplated herein other than an end bracket 30'. The base plate assembly 32 comprises a base plate 321, a sleeve 322, and a plurality of gusset plates 323. The base plate 321 is configured to be anchored to the building and the sleeve 322 extends away from the base plate 321. The gusset plates 323 are, in some embodiments, triangular and are attached between the base plate 321 and sleeve 322 to reinforce and strengthen the connection therebetween. In some embodiments, a plurality of gusset plates 323 are provided, located at orthogonal positions from one another.

The location of the sleeve 322 on the base plate 321 can vary depending on the configuration. For example, in some embodiments of the standard bracket 30, the sleeve 322 is located substantially at the center of the base plate 321. In some embodiments of the end bracket 30', the sleeve 322 is offset to the inside of the base plate 321. Additionally, the number of gusset plates 323 can vary depending on the configuration. For example, in some embodiments of the standard bracket 30, the four gusset plates 323 are provided at orthogonal positions around the sleeve 322. In some embodiments of the end bracket 30', three gusset plates 323 are provided as the of offset of the sleeve 322 to the inside does not provide or necessitate sufficient space for a gusset plate 323 at the inside position.

The base plate 321 is configured to be anchored to the building (such as to a column 20), by anchors, bolts, screws, or fasteners 327 disposed through the base plate 321 at a plurality of anchor points 324 (See also FIG. 1B). In some embodiments, the anchor points 324 are located at the corners of the base plate 321 and/or at locations adjacent to the gusset plates 323. The sleeve 322 extends away from the base plate 321 and, in some embodiments, is oriented substantially perpendicular thereto. The sleeve 322 is configured to receive and retain a pole 31 and includes one or more anchor points 325 through which a fastener may be received to secure the pole 31 to the sleeve 322 at corresponding anchor points 326 on the sleeve 322. In some embodiments, the distal end of each pole 31 includes a reinforcement 311 to resist wear that may occur due to forces exerted on the poles from the net 40 (and cables 41 and 42). Referring back to FIG. 1, the poles 31 may also include eyelets 312 to provide for easier attachment of the cables 41 and 42 however in some embodiments the eyelets 312 are omitted to provide a stronger connection. These optional features may be present in either or both bracket styles, 30 and 30'.

Figure 3:
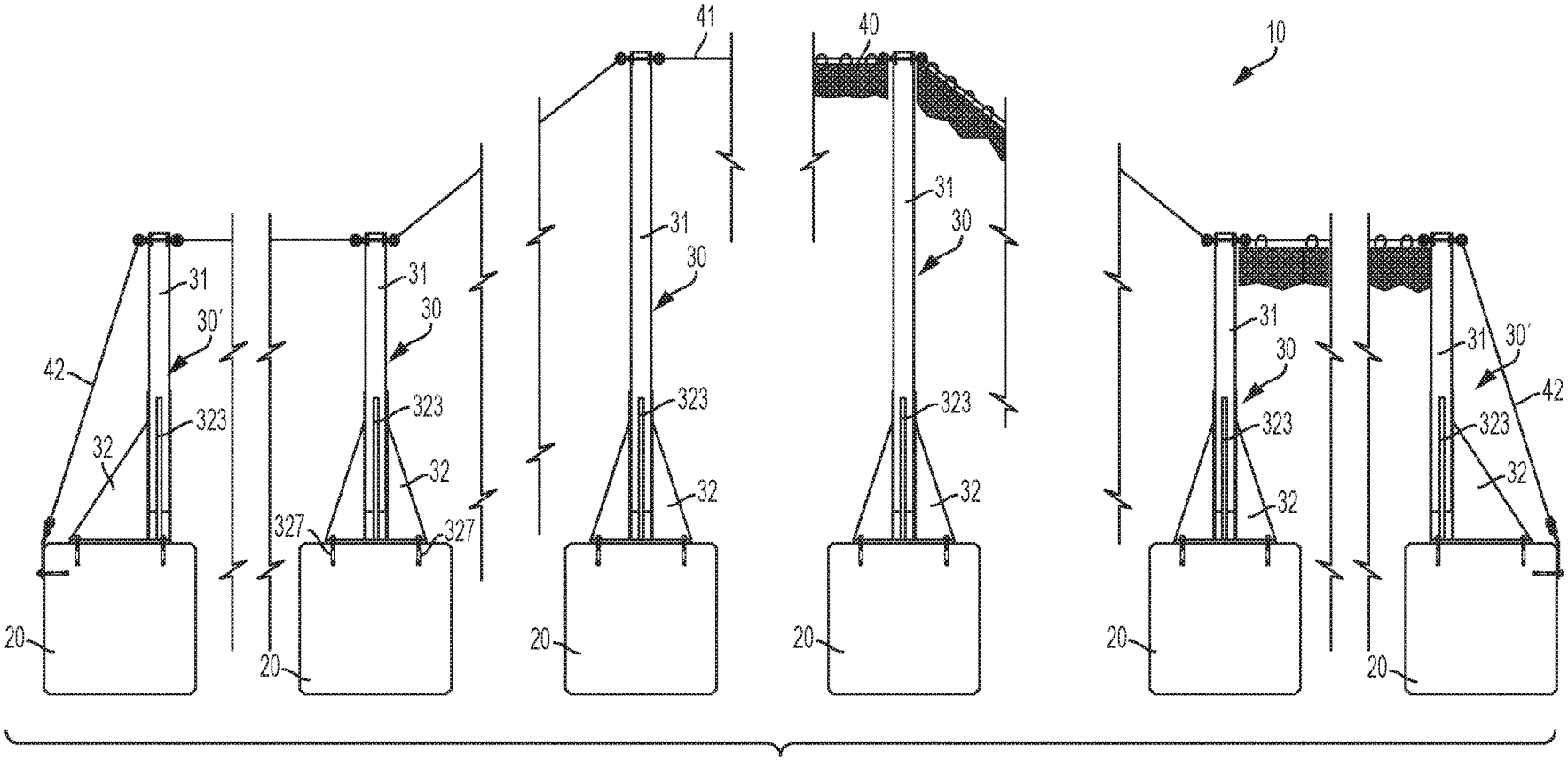
FIG. 3 is a top view schematic of another embodiment of the drop netting system.
Figure 4F:
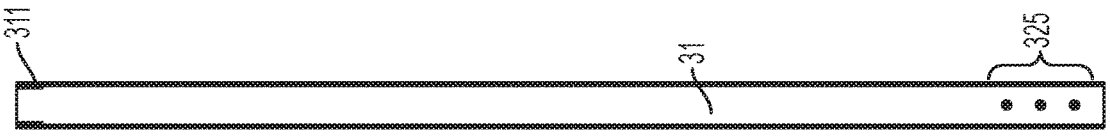
FIG. 4F is a side view of a long pole for a bracket of the embodiment shown in FIG. 3.
Figure 4E:
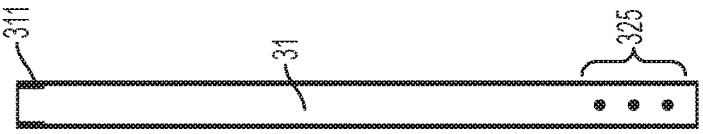
FIG. 4E is a side view of a short pole for a bracket of the embodiment shown in FIG. 3.
Figure 4B:
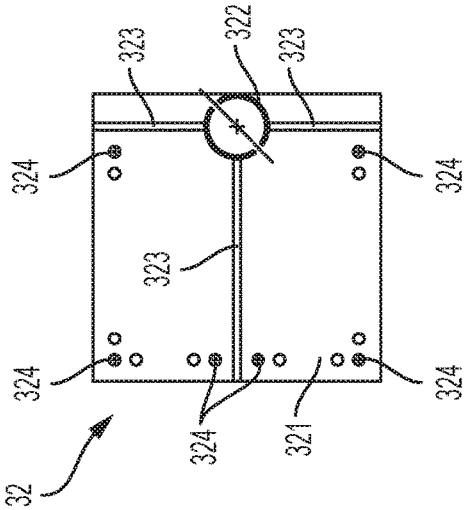
FIG. 4B is a top view of a base plate assembly for an end bracket of the embodiment shown in FIG. 3.
Figure 4D:
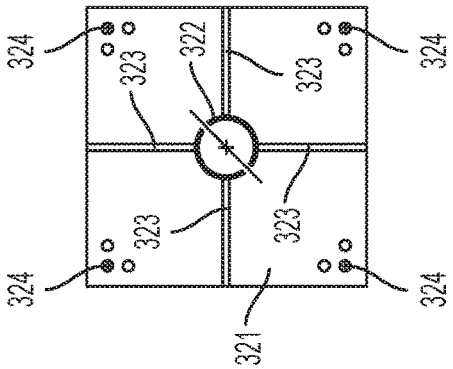
FIG. 4D is a top view of a base plate assembly for a standard bracket of the embodiment shown in FIG. 3.
Figure 4A:
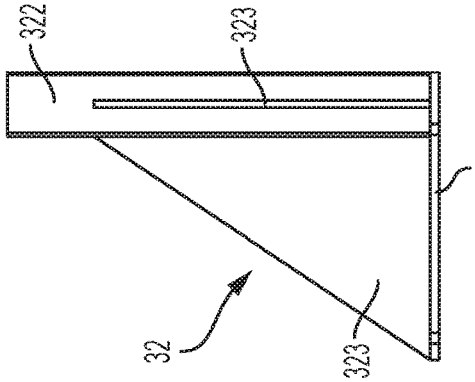
FIG. 4A is a side view of a base plate assembly for an end bracket of the embodiment shown in FIG. 3.
Figure 4C:
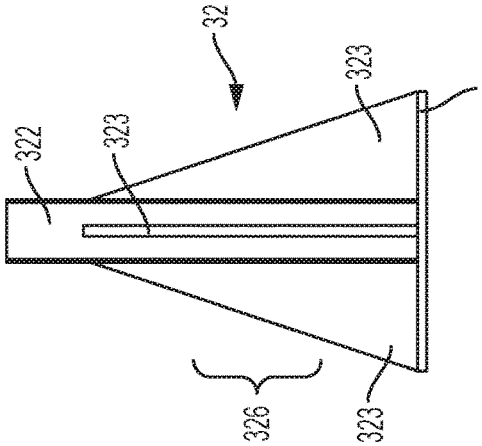
FIG. 4C is a side view of a base plate assembly for a standard bracket of the embodiment shown in FIG. 3.

FIG. 3 is an embodiment of the system 10 having brackets 30 and 30' with varying length poles 31. Specifically, in some embodiments, the central standard brackets 30 having longer poles 31 than the adjacent standard brackets 30 and end brackets 30'. This configuration allows the net 40 installation to conform to the profile of the features of the building during construction as it is evident that in some embodiments it is desirable to have the net 40 as close to the building face or surface as possible while still providing sufficient working space between the net 40 and the face or surface. FIGS. 4A-4E depict the various components of the system 10 as shown in FIG. 3. In some embodiments the base plate 321 of each base plate assembly 32 includes a cluster of anchor points 324 at each corner and adjacent to the gusset plates 323. These clusters of anchor points 324 provide the installer with anchoring options should there by rebar or other harder material behind one particular anchor point that would impede the ability to drive a fastener therethrough. Also shown in FIGS. 4E-4F are two different length poles 31 each with reinforced ends 311.

Figure 5:
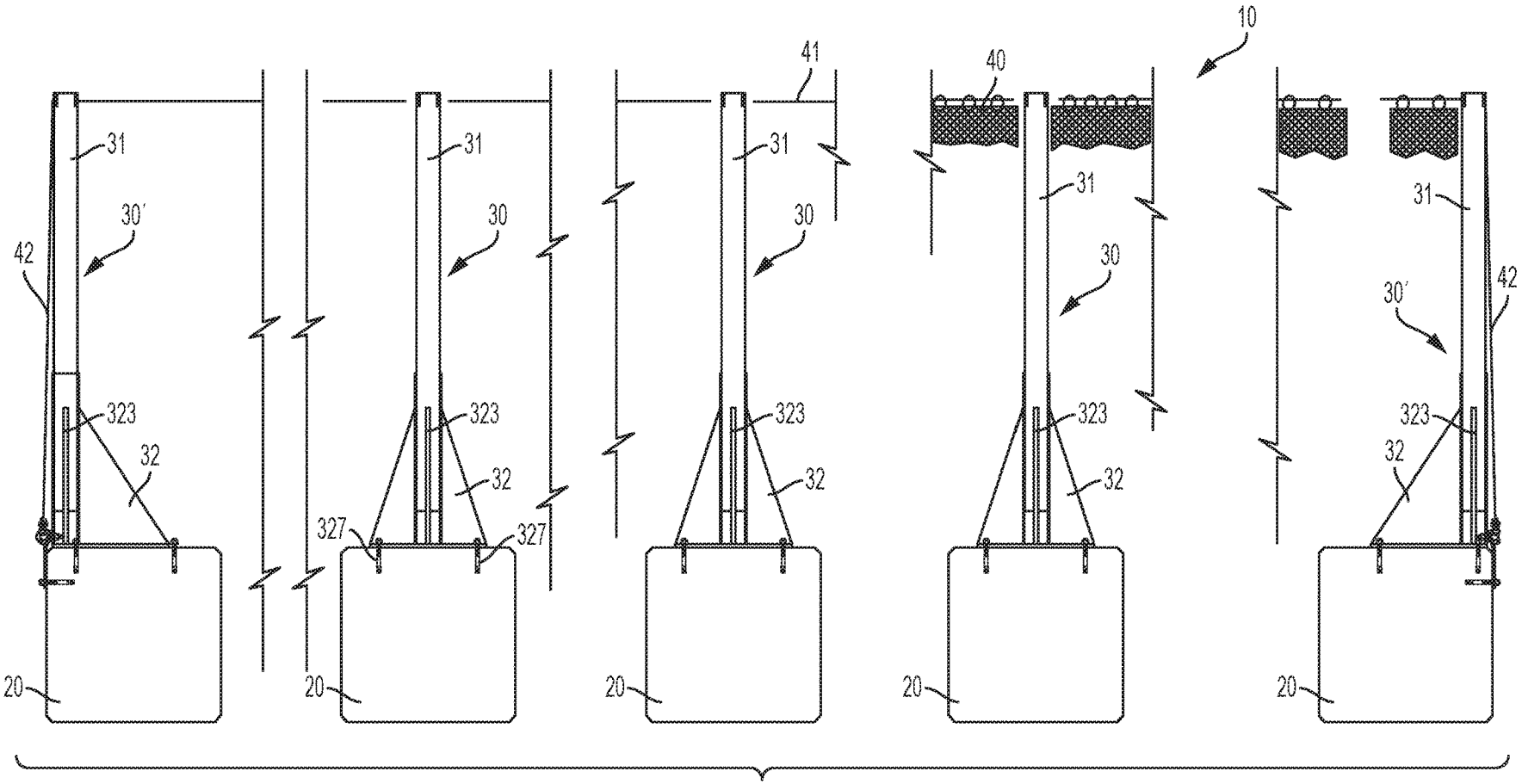
FIG. 5 is a top view schematic of yet another embodiment of the drop netting system.

With reference to FIG. 5, shown is another embodiment of the present invention. Here, the end brackets 30' are reversed such that the poles 31 thereof are offset to the outside edges of the respective columns 20. This is differentiated from the configuration shown in FIGS. 1 and 3, whereby the poles are offset toward the inside of their respective columns 20. In FIG. 5, the cables 42 at the outer sides of the system 10 have a less severe angle with respect to the pole 31 in comparison to the embodiment in FIGS. 1 and 3.

Figure 6A:
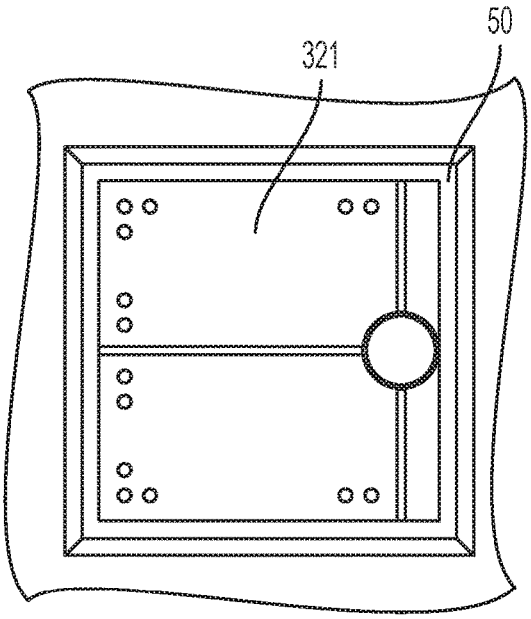
FIG. 6A is a top view of a base plate assembly for an end bracket of the embodiment shown in FIG. 5.
Figure 6B:
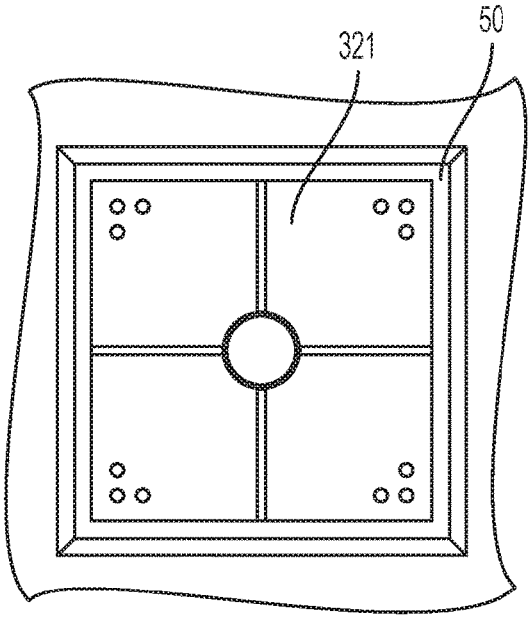
FIG. 6B is a top view of a base plate assembly for an standard bracket of the embodiment shown in FIG. 5.

FIGS. 6A-6B depict another feature of the present invention that is particularly useful when stucco or concrete is applied to the face or surface of the building. Generally speaking, when the brackets 30 and 30' are attached to the columns 20, the base plates 321 of each bracket have an inherent thickness away from the surface of the column 20 or other target surface. When stucco or concrete is applied, it can often be difficult to determine the proper depth of application at the site of the base plates 321 and further, when the bracket 30 or 30' is removed it can be difficult to properly level the application at the patch site. This can result in a slightly wavy or uneven application of stucco or concrete at the previous mounting location of the brackets 30 or 30'. Accordingly, the present invention solves this problem by introducing a removable frame 50 configured as a raised border disposed around the perimeter of the base plate 321 in order to provide a guide point for the proper thickness of a stucco or concrete application. Upon completion of the application the frame 50 can be removed (along with the bracket 30 or 30') and the resultant opening can be patched perfectly level to the depth of the existing application.

Figure 7:
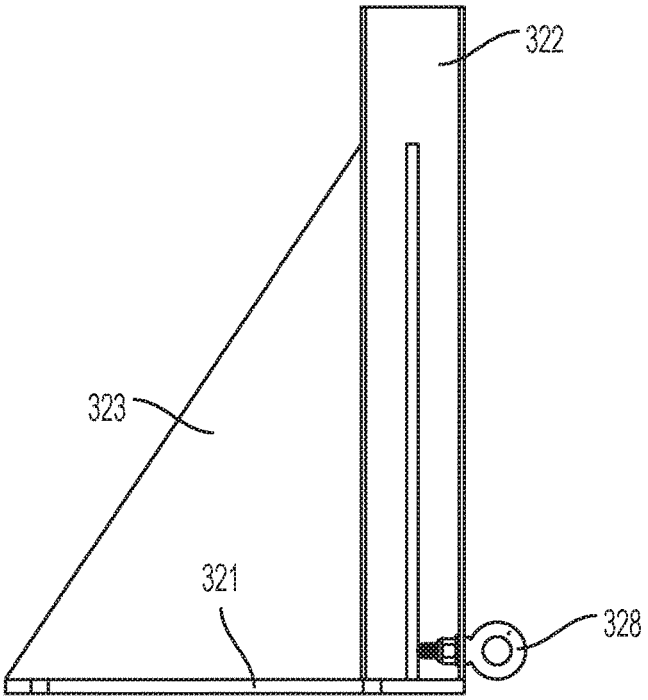
FIG. 7 is side view of one embodiment of the base plate assembly.

With reference to FIG. 7, in some embodiments the end bracket 30 includes an eyelet 328 on its outer face in order to provide an attachment for cable 42 to further reinforce the end brackets 30'.

Figure 8:
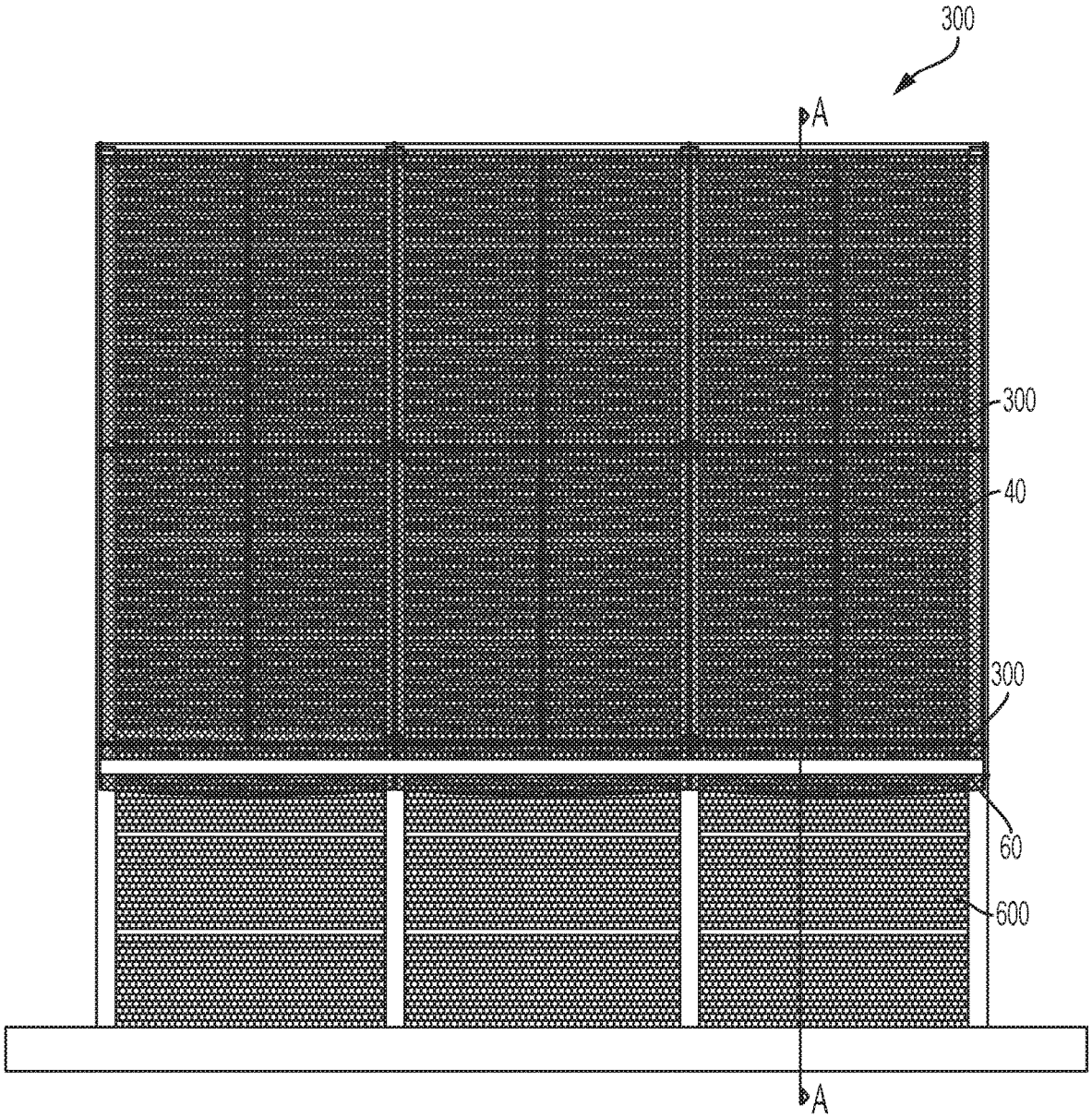
FIG. 8 is an front elevation view of one embodiment of the drop netting system deployed at the side a building.
Figure 9:
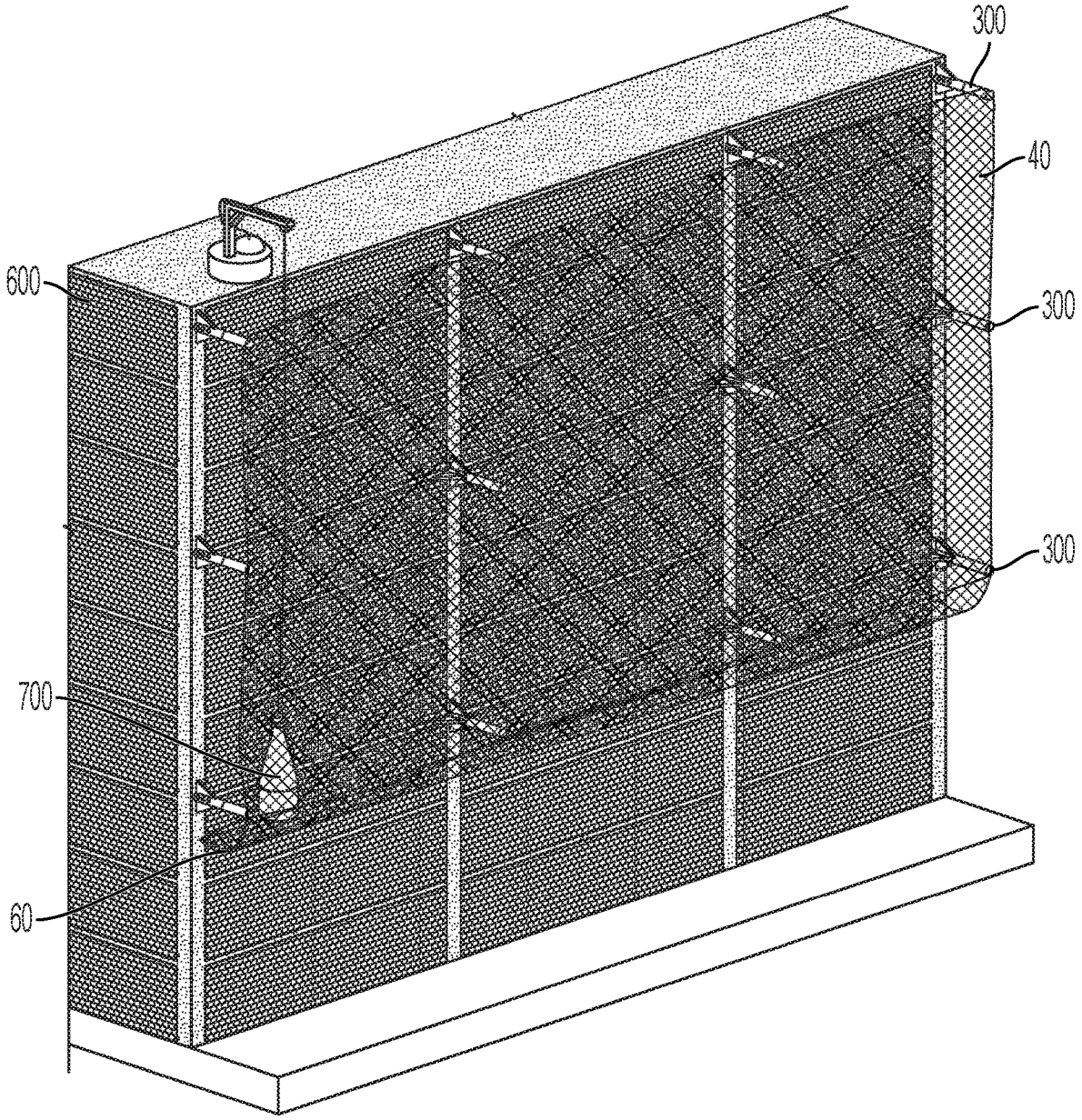
FIG. 9 is a side elevation view of another embodiment of the drop netting system.

The system 10 of the present invention is configured to be installed as a matrix in order to entirely cover a side of a building 600 or in fact cover an entire building in a sheath like fashion. Accordingly, with reference to FIGS. 8 and 9 shown is the system 10 in a deployed condition comprising a plurality of rows 300 of brackets 30 (and end brackets 30') in spaced apparent intervals along the side of the building 600 from top to bottom. A plurality of nets 40 are suspended across the rows 300 of brackets 30 and are attached to the distal ends of the brackets 30 in order to resiliently retain a array of nets 40 disposed across the entirety of the face of the building 600. The nets are configured so as to encase the surface of the building 600 disposed between the rows 300 of brackets. As shown the nets 40, by way of the bracket poles that extend away from the building, are spaced apart from the surface of the building in order to provide space for construction work, as depicted symbolically by winch basket 700. Additionally, the nets 40 at the bottom of the system 10 can be configured to be tied back to the face or surface of the building in order to provide a catch canopy 60 at the bottom of the building to collect debris that falls down and along the array of nets 40.

The present invention contemplates a method of installation of the system 10. In one embodiment of the method, one or more brackets 30 and 30' are provided at attached in successive rows to the a target support surface such as columns 20. Specifically, the base plates 321 of each such base plate assembly 32 of each bracket 30 is anchored to the support surface. Next, the poles 31 are inserted into the respective sleeves 322 of each base plate assembly 32 and optionally are fastened to the sleeves 322. Next, cables 41 and 42 are deployed with cables 41 attached between and along the distal end of each of pole 31. Cables 42 are attached at the end brackets 30', at one end to the distal end of the pole 31 and at the other end either to the support surface or back to the base plate assembly 32 of the respective bracket 30'. Next, one or more nets are suspended and attached to the cables 41 and 42. Another row 300 of brackets 30 and 30' is then provided adjacent to the first row, typically above or below same, and the assembled in light fashion such that the nets 40 are suspended and attached between the adjacent rows. Additional rows and nets are deployed as needed to cover all or a portion of a building. Optionally, at the bottommost row 300 of brackets 30' one or more nets 40 are terminally attached at the building surface so as to form a catch canopy 60 at the bottom of the array of nets. As noted previously, the nets 40 will end up being spaced apart from the surface of the building in order to allow workers access for construction activities all the while retaining and preventing the spread of debri.

The netting system is also designed to be modular in order to permit its usage in a variety of applications and with various sized, shaped, and configured building structures. The system 10 may can be employed in a variety of building applications including high rise construction, low rise construction, bridge construction, and the like.

It is appreciated and understood that the various brackets may comprise materials of varying material and cross-section. For example, wood, steel, aluminum, and combinations thereof may be employed. Cross-sections may vary as the bracket beams may be tubular, square, or L-shaped. The means and manner by which the brackets 30 and 30' are secured to the columns 20 or other target surface is not limiting although in some embodiments concrete bolts, screws or like fasteners can be used. Other hardware may be utilized to reinforce the attachment points on the columns 20. The net 40 can vary in type, thickness and designed although it may desirable to employ a net 40 with a fine mesh backing or fine mesh array in order to retain and prevent the dispersion of debris, especially that occurring during stucco, tile, and concrete application. By way of non-limiting example, it is helpful to describe certain relative dimensions of system components. In some embodiments, it is desirable for each of the poles 31 to extend away from the building by at least 72-96 inches to provide optimal clearance for construction while also remaining effective for the net 40 to capture debris. It is further understood that the use and reference to columns 20 is exemplary in nature only as the brackets 30 and 30' are configured to be mounted to a variety of target surfaces and features of a building's face or surface. Indeed, "face or surface" as used herein refers generally any side or face of a building and not necessarily the front.

While specific embodiments have been described in detail, those with ordinary skill in the art will appreciate that various modifications and alternatives to those details could be developed in light of the overall teachings of the disclosures. Accordingly, the particular arrangements disclosed are meant to be illustrative only and not limiting of the invention, which is to be given the full breadth of the appended claims, and any and all equivalents thereof.

What is claimed is:

1. A netting system for debris retention, comprising:

a first row of a plurality of spaced apart brackets configured to be attached to a surface of a building;

a second row of a plurality of spaced apart brackets configured to be attached to said surface of said building, said second row disposed below said first row;

each of said first row and second row of brackets including one or more standard brackets and two end brackets;

each of said standard and said end brackets comprising a base plate, a sleeve extending away from said base plate, and a pole received and retained in said sleeve, said pole configured to extend away from said surface of said building;

each of said standard brackets including four gusset plates attached between said base plate and said sleeve, wherein said sleeve of each of said standard brackets is located substantially at a center of said base plate thereof;

each of said end brackets including only three gusset plates attached between said base plate and said sleeve, wherein said sleeve of each of said end brackets is offset from a center of said base plate thereof;

a first cable attached to each distal end of said brackets of said first row;

a second cable attached to each distal end of said brackets of said second row; and a net attached to both of said first and said second cables and suspended across said first and second rows, such that said net is disposed across, spaced apart from, and conforms to a profile of one or more of said first and second row of brackets; and wherein said net is configured to encase a space of said building disposed between said first row and said second row of brackets.

2. The netting system of claim 1, wherein said base plate includes a cluster of anchor points disposed at each corner thereof.

3. The netting system of claim 1, wherein said base plate further includes a removable frame comprising a raised border disposed around a perimeter of said base plate.

4. The netting system of claim 1, wherein at least an upper portion of said net is configured to be spaced apart from said surface of said building.

5. A method of installing and securing the netting system of claim 1, comprising:

attaching said first row of said brackets to a said surface of said building;

attaching said second row of said brackets to a said surface of said building;

attaching said first cable to each said distal end of said brackets of said first row;

attaching said second cable to each said distal end of said brackets of said second row;

attaching and suspending said net across each of said first and said second cables.

* * * * *